United States Patent [19]

Okonogi et al.

[11] Patent Number: 4,536,233

[45] Date of Patent: Aug. 20, 1985

[54] COLUMNAR CRYSTAL PERMANENT MAGNET AND METHOD OF PREPARATION

[75] Inventors: Itaru Okonogi; Tatsuya Shimoda, both of Suwa, Japan

[73] Assignee: Kabushiki Kaisha Suwa Seikosha, Tokyo, Japan

[21] Appl. No.: 556,751

[22] Filed: Nov. 30, 1983

Related U.S. Application Data

[63] Continuation-in-part of Ser. No. 330,977, Dec. 15, 1981, abandoned.

[30] Foreign Application Priority Data

Dec. 16, 1980 [JP] Japan ..... 57-177892

[51] Int. Cl.[3] ..... H01F 1/02

[52] U.S. Cl. ..... 148/101; 148/103; 148/104; 148/31.57

[58] Field of Search ..... 148/31.57, 101, 102, 148/103, 104, 105, 108

[56] References Cited

U.S. PATENT DOCUMENTS

| | | | |
|---|---|---|---|
| 3,546,030 | 12/1970 | Buschow | 148/103 |
| 3,560,200 | 2/1971 | Nesbitt et al. | 148/103 |
| 3,811,962 | 5/1974 | Benz | 148/101 |
| 3,816,189 | 6/1974 | Haberer et al. | 148/101 |
| 3,998,669 | 12/1976 | Strnat | 148/31.57 |
| 4,131,495 | 12/1978 | Menth et al. | 75/170 |
| 4,135,953 | 1/1979 | Nagel et al. | 148/103 |
| 4,213,803 | 7/1980 | Yoneyama et al. | 148/102 |
| 4,289,549 | 9/1981 | Kasai | 148/101 |

*Primary Examiner*—John P. Sheehan

*Attorney, Agent, or Firm*—Blum Kaplan Friedman Silberman & Beran

[57] ABSTRACT

A permanent magnet formed from a powdered alloy ingot of samarium (Sm) and cobalt (Co), copper (Cu), and iron (Fe) and at least one element selected from the group consisting of zirconium (Zr), titanium (Ti), hafnium (Hf), tantalum (Ta), niobium (Nb), and vanadium (V), formed predominantly of $Sm_2Co_{17}$ crystals and having at least 50 volume percent columnar crystals in the macrostructure is provided. The alloy ingots having increased columnar crystals are prepared by melting the alloy composition at a temperature at least about 320° C. above the melting point of the composition and casting the ingot at a casting speed faster than about 5.0 sec/kg of alloy.

25 Claims, 16 Drawing Figures

FIG. 1
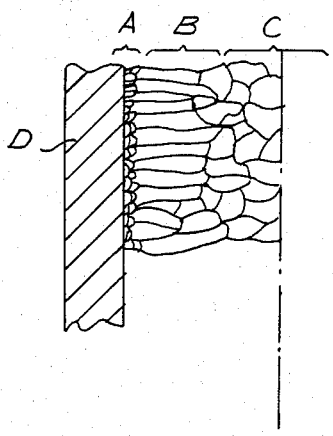
FIG. 3(a)
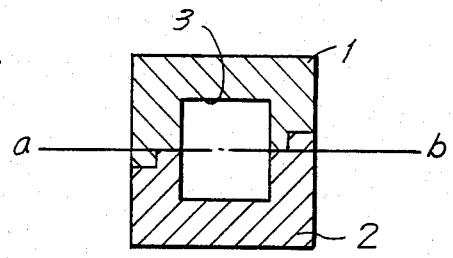
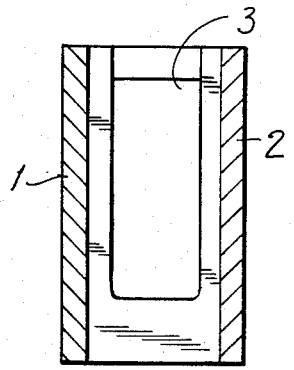
FIG. 3(b)
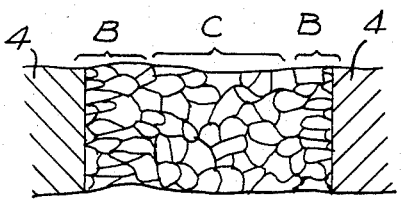
FIG. 4
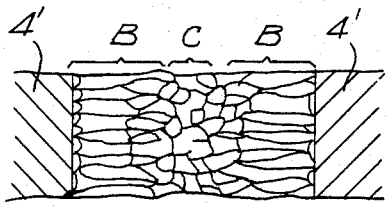
FIG. 5

FIG. 11
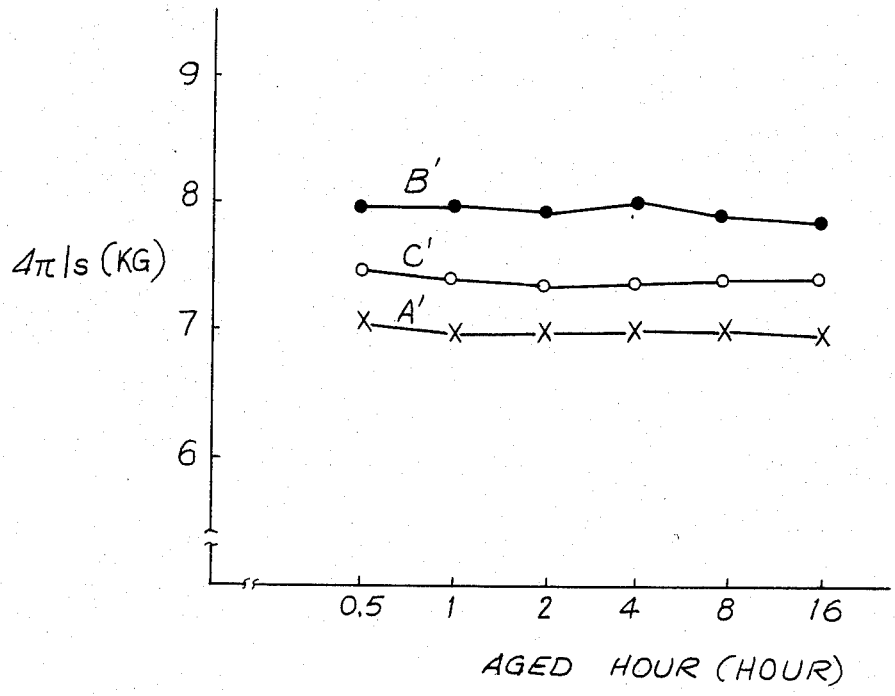
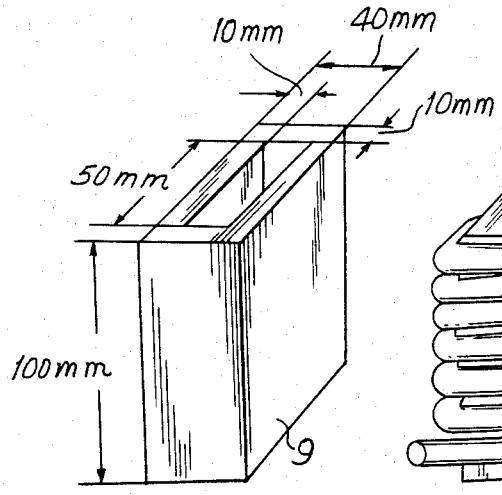
FIG. 12 (a)
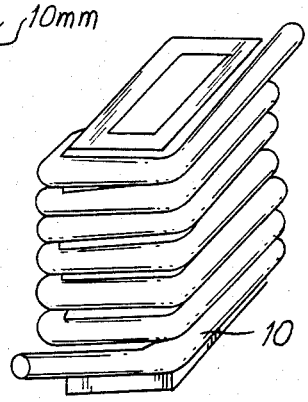
FIG. 12 (b)

COLUMNAR CRYSTAL PERMANENT MAGNET AND METHOD OF PREPARATION

CROSS-REFERENCE TO RELATED APPLICATIONS

This application is a continuation-in-part of copending application Ser. No. 330,977, filed on Dec. 15, 1981 abandoned.

BACKGROUND OF THE INVENTION

This invention relates generally to an improved permanent magnet and more particularly to an improved permanent magnet including predominantly an alloy of $Sm_2Co_{17}$ crystals having a predominantly columnar macrostructure and to a process for preparing the improved permanent magnets.

Permanent magnet compositions including a samarium alloy, such as, $Sm_2Co_{17}$ are known to provide improved magnetic properties over conventional Alnico magnets. Such magnets are described in U.S. Pat. No. 4,289,549 issued to kazutomo Kasai on Sept. 15, 1981 and assigned to the same assignee as the subject application. In connection with conventional Alnico magnets, it is known that a cast structure provides magnets with columnar crystalization. These permanent magnets are described in *Magnets with Columnar Crystallization* by J. E. Gould in Cobalt, No. 23 (June, 1964, pp 82–87).

While the resin-bonded permanent magnet composition disclosed in the patent to Kasai are superior to many prior art compositions, magnet compositions having even more improved magnetic properties are still required. Accordingly, it is desirable to provide powder-bonded type permanent magnet compositions having improved crystal anisotropy.

SUMMARY OF THE INVENTION

Generally speaking, in accordance with the invention, improved columnar crystal permanent magnet compositions and a method of production are provided. The permanent magnets are formed from an alloy including samarium (Sm) and cobalt (Co), copper (Cu) and iron (Fe), and at least one element (M) selected from the group consisting of zirconium (Zr), titanium (Ti), hafnium (Hf), tantalum (Ta), niobium (Nb) and vanadium (V) in a form predominantly of $Sm_2Co_{17}$ crystals, the alloy after being cast having a predominantly columnar macrostructure. The columnar crystals are present in at least about 50 volume percent of the macrostructure. The magnetic compositions in accordance with the invention are preferably powder-bonded type magnets wherein the alloy is strengthened by using an organic resin or metal binder.

The alloy of the permanent magnet composition includes the following:

| Component | Amount (Weight Percent) |
|---|---|
| Sm: | 21.0–28.0 |
| Cu: | 3.0–10.0 |
| Fe: | 14.0–35.0 |
| M: | 0.5–5.0 |
| Co: | Balance to 100 |

The permanent magnets are prepared by melting the alloy composition to a temperature of at least 320° C. above the melting point of the alloy and casting to form an ingot at a casting speed of at least 5.0 sec/Kg. The bulk ingots of the alloy are subjected to a heat treatment for magnetic alloy hardening, pulverized to powder having an average particle size of not more than 50 $\mu$m, mixed with an organic resin or metal binder and the mixture is compacted or molded into a desired shape under a magnetic field in order to produce a powder-bonded magnet.

Accordingly, it is an object of the invention to provide an improved material for a high performance permanent magnet.

Another object of the invention is to provide an improved permanent magnet from an alloy formed predominantly of $Sm_2Co_{17}$ crystals having a predominantly columnar macrostructure.

A further object of the invention is to provide an improved $Sm_2Co_{17}$ alloy powder-bonded permanent magnet.

Still another object of the invention is to provide a method for preparing improved permanent magnet compositions.

Still a further object of the invention is to provide a method for preparing improved permanent magnet formed predominantly of $Sm_2Co_{17}$ crystals having a predominantly columnar macrostructure.

Still other objects and advantages of the invention will in part be obvious and will in part by apparent from the specification.

The invention accordingly comprises the several steps and the relation of one or more of such steps with respect to each of the others, and the composition possessing the features, properties, and the relation of constituents, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a cross-sectional representation of the macrostructure of an ingot of the alloy prepared in accordance with the invention;

FIG. 3(*a*) is a plan view and FIG. 3(*b*) is a cross-sectional view of a casting mold utilized in accordance with the invention;

FIG. 4 is a cross-sectional representation of the macrostructure of an alloy prepared conventionally;

FIG. 5 is a cross-sectional representation of the macrostructure of an alloy obtained in accordance with the invention;

FIG. 11 is a graph illustrating the relationship between the aging time and saturation magnetization ($4\pi Is$) from the magnets prepared from the ingot of FIG. 9;

FIG. 12(*a*) is a perspective view illustrating an annular iron casting mold for preparing ingots in accordance with the invention;

FIG. 12(*b*) is a perspective view of the mold of FIG. 12(*a*) modified for water-cooling;

DESCRIPTION OF THE PREFERRED EMBODIMENTS

Figure 2:
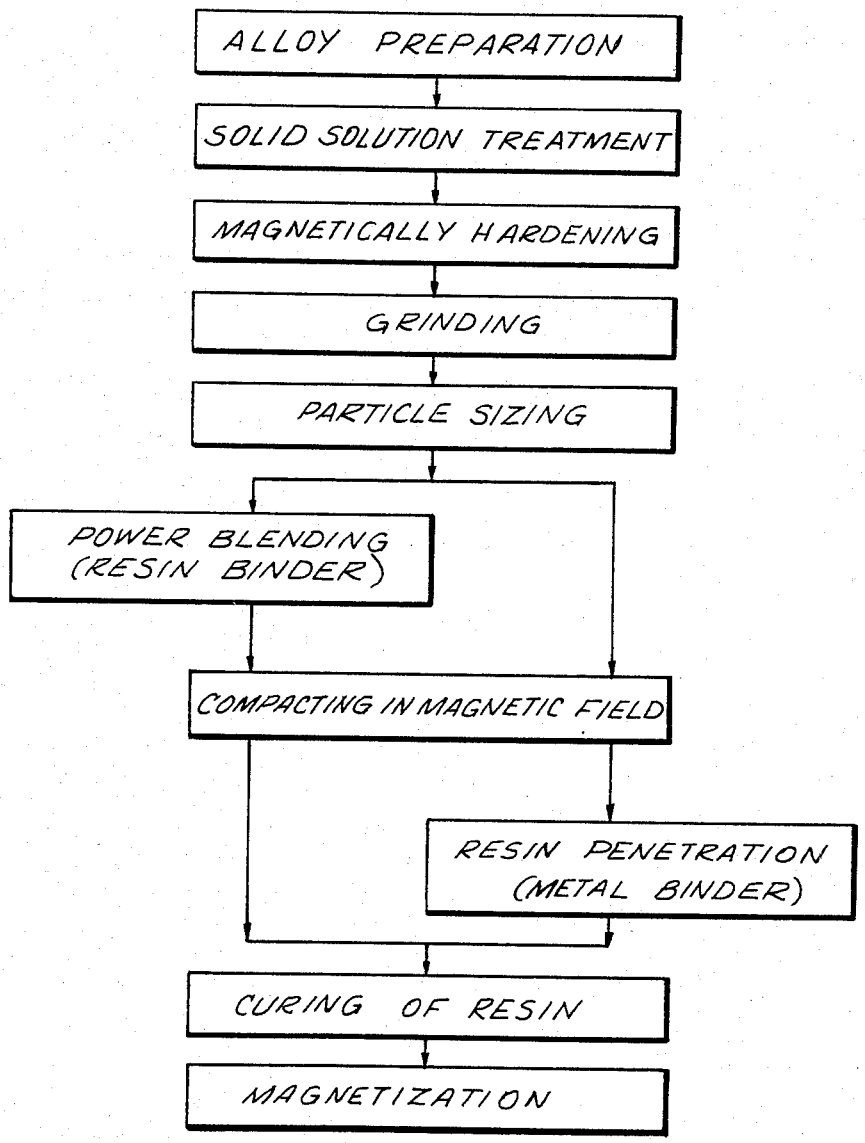
FIG. 2 is a flow chart illustrating a process for manufacturing the permanent magnets in accordance with the invention.

Generally, when a molten metal is poured from a crucible into a mold, solidification of the metal starts at the mold wall and proceeds inwardly. This phenomenon is explained by the theory that a seed crystal in contact with the mold wall has a lower energy barrier than a seed crystal not in contact with the wall but migrating within the molten metal, and therefore more likely to become the nucleus of a crystal. These crystals formed on the old wall continue to grow into the molten metal while competing with adjacent crystals. The region A in the outer-most layer of the ingot, where the crystals are completing with each other to grow, is called the chilled layer. This region A is shown in FIG. 1.

As the crystals tend to grow in the direction of easy growth, it tends to grow preferentially along the direction parallel to that of the heat gradient. Therefore, the crystals which grow parallel to the heat gradient prevents the growth of adjacent crystals that are not parallel to the heat gradient. During the growth of the crystals, the crystals grow towards the center of the mold. These crystals, whose direction of growth coincide with the direction of the heat gradient, survive longer than and sacrifice other crystals in their path, so that the number of crystals gradually decrease. As a result of this, the columnar zone B is formed. When the conditions are adequate, the opposed fronts of the columnar zones approach each other and eventually collide with each other bringing solidification of the molten metal to completion.

Generally, an equi-axed structural zone C is formed inside the columnar zone as shown in FIG. 1. The cause for formation of this equi-axed structure was not understood formerly. Recently, it has been stated that crystals formed at the mold wall or the cooled surface of the molten metal liberate themselves from the boundary face to become floating crystals in the molten metal and it is these crystals that give birth to the equi-axed structural zone. (A. Ohno, T. Motegi and H. Soda: Trans. ISIJ, 11 (1971) 18).

A magnet which is made from a five-element alloy of a mixture of Sm-Co-Cu-Fe-M is called a precipitation hardened magnet or a phase-separation magnet. This is because the magnet hardening is caused by precipitation of a second phase in a matrix. Presently, two production methods are available for the production of commercial two-phase separation magnets. The first is the sintering method and the second is the formation of a powder-bonded type magnet.

The sintering method induces growth of particles during sintering owing to liquid-phase or solid-phase atomic diffusion. Magnetic particles measuring 2 through 3 μm attain growth to 10 through 50 μm by sintering and recrystallization, for example. The sintering method is disadvantageous in that the crystsls inherent in the original alloy ingot cannot be retained and the composition changes greatly. Among the component elements, the amount of the rare earth metal samarium (Sm) in the alloy dwindles due to oxidation and vaporization losses. Producing a magnet from an alloy in the optimum composition fails to attain the prescribed magnetic properties without compensating adequately for the loss of the elements. Furthermore, the magnetic properties tend to vary widely within lots or between different lots of magnets prepared.

The second method, or the powder-bonded method, involves a resin or metal bound magnet which is obtained by subjecting bulk ingots of alloy to a thermal treatment for magnetic hardening, pulverizing the ingots, and binding the powder with a resin or metal binder. The permanent magnets prepared in accordance with the present invention are manufactured by this procedure which is illustrated in the flow chart in FIG. 2.

As shown in FIG. 2, the magnet properties are heavily effected by the cast structure, unlike the magnet obtained by the sintering method. It has been calculated that when an Sm-Co-Cu-Fe-M alloy is cast and divided by its macro-structure into three fractions, the first with equi-axed crystals, the second with columnar crystals and the third with chilled crystals, the magnet made from the fraction of columnar crystals exceeds the magnetic properties of the magnet formed from the other fractions. This is true for all magnetic properties, including saturated magnetization ($4\pi Is$), coercive force (iHc, bHc), and squareness of the hysteresis loop. Conversely, the alloy fractions with equi-axed crystals and chilled equi-axed crystals are inferior in properties. The alloy fraction of chilled and columnar crystals produces a magnet possessing the physical constants intermediate between those of the magnet produced from the other alloy fractions.

Since an alloy of columnar crystals has its crystals arranged in one fixed direction, a permanent magnet made of this alloy has good mono-axial orientation of its crystals. Because production of a magnet in accordance with the invention utilizes the original crystal structure of the ingot per se, unlike the conventional method, it is natural to consider control of the casting structure. Furthermore, in a multi-element alloy in accordance with the invention, precipitate produced by thermal treatment is a more homogenous structure than that produced by any other method, due to the fact that the alloy is composed predominantly of columnar crystals. Consequently, the alloy also exhibits a more square hysteresis loop. Moreover, the crystalline structure and configuration of the precipitates are improved in accordance with the invention which contribute towards enhancing the coercive force (iHc) more than an alloy of equi-axed crystals.

In order to obtain an acceptable magnet, it is necessary to provide a method of manufacture which is capable of casting an alloy in accordance with the invention in such a manner that the chilled crystal zone in the immediate neighborhood of the mold wall comprises chilled columnar crystals and the remaining part comprises columnar crystals. In crystallization of an alloy ingot, the preparation of columnar crystals can be increased by properly setting various conditions such as the temperature of the molten surface before casting, the manner of casting, the cooling rate of the cast molten metal and the speed of solidification. In accordance with this invention, it is desired that alloy ingots contain columnar crystals amounting to not less than 30 percent by volume. It is preferred that this proportion be at least 50 percent and most preferably be at least 70 percent. In order to obtain such alloy ingots in accordance with the invention, the melting temperature is at least 320° C. above the melting point of the alloy composition and the casting speed is faster than 5 sec/Kg of the alloy.

The alloy compositions in accordance with the present invention include samarium (Sm) in the range of about 21–28 percent, by weight. If the samarium content is less than 21 percent, the alloy permits the growth of a Fe-Co phase in addition to the $Sm_2Co_{17}$ phase. Consequently, the squareness of the hysteresis loop is degraded and the coercive force (iHc) is severely degraded. If the samarium content exceeds 28 percent, a portion of the $SmCo_5$ phase, which takes away from the $Sm_2Co_{17}$ phase, increases and the saturated magnetization ($4\pi Is$) decreases, and the energy product also declines. Thus, the upper samarium content is set at 28 weight percent.

The copper content of the magnet composition is between about at least 3 percent up to 35 percent by weight. The 3 percent minimum is maintained in order to permit desired acceleration of the hardening of the precipitate. If the copper content exceeds 10 percent, however, the saturation magnetization ($4\pi Is$) and the squareness of the hysteresis loop are impaired. Iron occupies the cobalt site in the $Sm_2Co_{17}$ crystal, and improves the saturated magnetization ($4\pi Is$) and lends itself to increasing the energy product. If the iron content is permitted to exceed about 35 percent, the $Sm_2Co_{17}$ crystals can no longer be maintained and the coercive force (iHc) is impaired. Thus, the iron content is maintained below the upper limit of about 35 weight percent.

The additional element denominated M is a metal selected from the group consisting of Zr, Ti, Hf, Ta, Nb, and V and is present in the alloy up to about 5 weight percent. If the content of M exceeds 5 percent, the saturated magnetization ($4\pi Is$) is degraded substantially. If the M content is less than about 0.5 weight percent, the alloy fails to acquire the minimum 4000 Oe of coercive force (iHc), the minimimum value for the permanent magnet. When the element M is incorporated into the alloy, it is expected that it will be dispersed uniformly throughout the ingot alloy and improve the form of the precipitate, promote the fixation of nitrogen in addition to improving the magnet properties.

The element M may be present within the range from 0.5 to 5 weight percent. When present in this amount, M may be incorporated in the form of a single element formed of a combination of two more elements from the above group. When at least two elements are included, the addition of M to the alloy has at least the same or a better effect in improving magnetic properties than when a single element is included. The remainder of the alloy composition is accounted for by cobalt. It is desirable to maintain the level of impurities which inevitably creep into the alloy from the raw materials used during the manufacturing process (melting, casting, thermal teratment and pulverization) to no more than about 0.5 weight percent of the composition.

The significant points which control the magnetic properties of the alloy prepared in accordance with the process of the invention during and after the step of pulverization, are enumerated below.

1. The magnetic powder is prepared by utilizing a suitable machine, such as, for example, a jet mill, a ball mill, a hammer crusher, or a top mill provided with means for preventing oxidation of the magnetic powder. It is desired that the magnetic powder have an average particle size of not more than 50 microns. Preferably, the average particle size of the magnetic powder falls within the range of from about 10 to 20 microns and that the largest particle diameter is not more than 100 microns. When particle size falls outside this range, the orientation in the magnetic fields is impaired and the residual magnetic flux density (Br) is adversely effected. Additionally, the die used for pressing the powder tends to wear so that accurately molded magnets will not be obtained.

2. The binder utilized for binding the magnetic powder may be either an organic polymer or a metal. Examples of organic binders which may be advantageously utilized in the invention, include thermoplastic and thermosetting resins, such as, epoxy resins, EVA (ethylene vinyl acetate), rubber, polyester and nylon. The resin is utilized in an amount roughly in the range of from about 1.0 to 15 weight percent with the magnetic powder making up the balance to 100 weight percent. The resultant mixture is molded or compacted into a desired shape in a magnetic field and thermally solidified.

A metal or alloy having a melting point (M.P.) of not more than 400° C. may be utilized as the metal binder. When a metal binder is used, it is mixed with the magnetic powder or applied to the surface of the particles of a magnetic powder by plating. Examples of such metals which may be utilized advantageously in accordance with the invention, include Zn (M.P. 419.5° C.), Cd (M.P. 320.9° C.), In (M.P. 156.6° C.), Sn (M.P. 231.9° C.), Pb (M.P. 327.3° C.) and Bi (M.P. 271° C.) Alloys including these metals may also be utilized. The metal binder is plated to the surface of the particles of the magnetic powder by a non-electrolytic nickel plating or vacuum deposition technique, such as the spattering method, ion plating, CVD or PVD.

The present invention will now be described in detail in the following examples. These examples are intended to be illustrative and are not presented in any limiting sense. All percentages specified are weight percents, based on a total weight of composition, unless otherwise indicated.

EXAMPLE 1

In an atmosphere of argon gas, 1 kg of raw material was melted and cast in a mold of the type illustrated in FIG. 3. The alloy prepared had a composition of 23.54 percent Sm, 5.78 percent Cu, 21.77 percent Fe, 1.9 percent Zr and the balance Co to make up 100 weight percent. The chemical formula of the alloy can be represented as follows:

$$Sm(Co_{0.614}Cu_{0.07}Fe_{0.3}Zr_{0.016})_{8.3}$$

In accordance with conventional techniques, the temperature of the molten metal was about 1460° C. and the casting speed was 1 kg/10 seconds to provide for slow casting. Cooling is by air and the mold was made of a material of Grade S15C consisting of a pair of matched dies 1 and 2 forming a cavity 3 for receipt of the molten alloy. The ingot is a rectangular column measuring 35 mm×35 mm×80 mm.

The cross-section of the macrostructure of the ingot obtained is shown in FIG. 4. The mold wall is shown as 4, the columnar crystals are denoted by B and equi-axed crystals are denoted by C. Equi-axed crystals C account for about 60–70 percent of the volume and columnar crystals B for a fairly small proportion.

The same composition was cast in accordance with the invention. In this case, the composition was melted with high-frequency waves in an atmosphere of argon gas and cast in the same mold as shown in FIG. 3. The molten metal was cast at a temperature of 1580° C. at a casting speed of about 3–5 seconds/kg. The alloy had a melting point of 1260° C. and the casting was carried out at a temperature 320° C. higher than the melting point. Consequently, the amount of solidification nuclei produced after introduction of the molten alloy into the mold was decreased which promoted growth of columnar crystals. Following casting, the alloy ingot was subjected to the processing steps as illustrated in the flow chart in FIG. 2, including the steps of: thermal treatment—pulverization—incorporation of binder—compressing the mixture of magnetic powder with binder in a magnetic field—compression moldin-g—curing—BH measurement as a test for magnetic properties.

Figure 6:
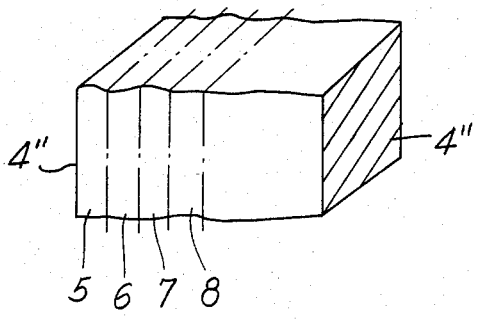
FIG. 6 is a prespective view illustrating the positions at which test pieces were cut from an alloy ingot prepared in Example 1 in accordance with the invention.

For the thermal treatment step, 200 g of bulk ingot was separated. The ingot was heated so that the temperature of the central portion in the direction of length reaches 1150°±2° C. for 20 hours and then cooled at room temperature at a rate of about 20°–25° C. per minute. Subsequently, in an atmosphere of argon gas, the ingot was heated to 800°±3° C. for 24 hours and quenched at a rate of about 15°–20° C. per minute. After magnetic curing treatment, the ingot was cut at intervals of 4 mm from mold wall 4 as illustrated in FIG. 6. The cut sections are serially numbered 5, 6, 7 and 8 from the mold wall towards the center of the ingot. Thus, section 8 falls at the center of cross-section of the ingot.

Figure 7:
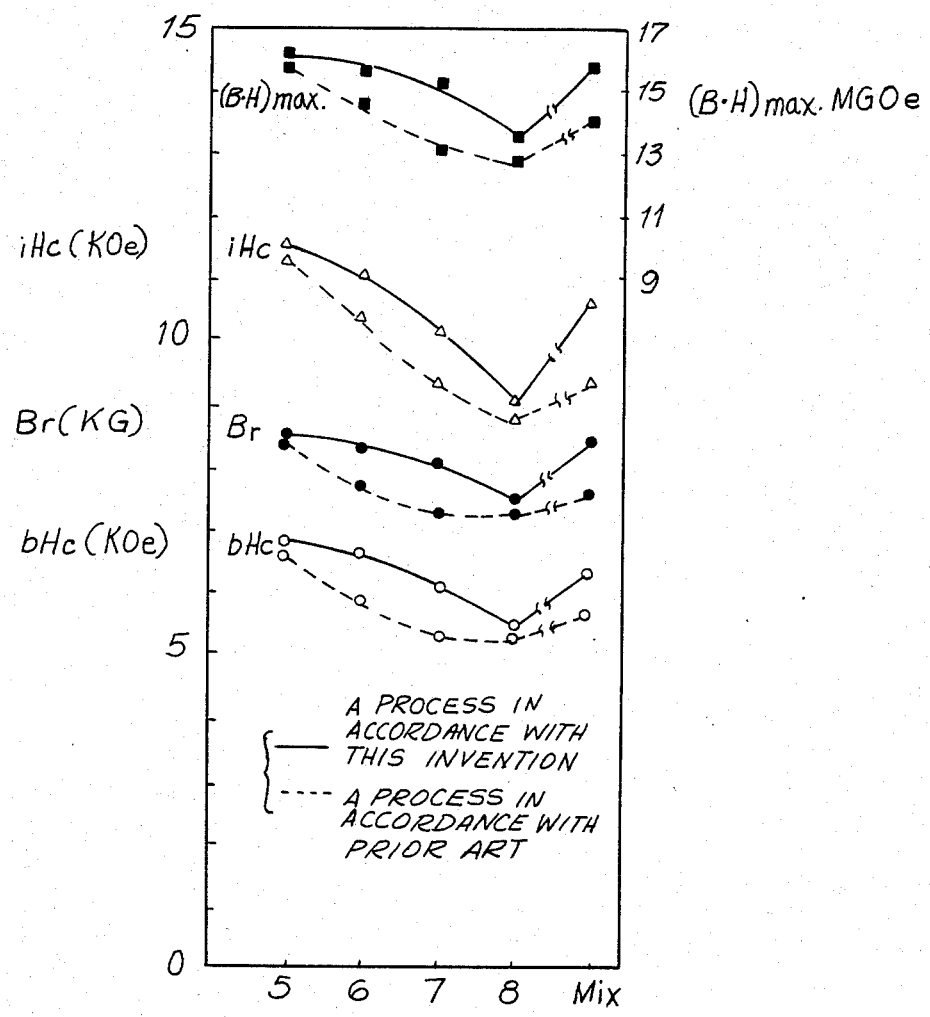
FIG. 7 is a graph illustrating the magnetic properties of the various test pieces cut from the ingot prepared in Example 1.

Each specimen 5, 6, 7 and 8 was pulverized separately to a powder having an average particle size of 12 μm. The powder was mixed in a mortar with 1.9 weight percent of a one-component type epoxy resin binder and each was compressed in a magnetic field. The strength of the magnetic field was between about 15–18 KG and the maximum compression pressure was 5 tons/cm$^2$. The compression yielded a cylindrical test piece 15 mm in diameter and 5 mm in length. It was cured at 150° C. for three hours and measured for BH curves on a DC self-recording magnetic flux meter. The magnetic properties of the test piece were determined as shown in FIG. 7.

The test pieces having the columnar structure and that having an equi-axed structure are clearly different from each other. The symbol "mix" indicated in FIG. 7 represents the data obtained of a test piece prepared by pulverizing the remaining half of the ingot of FIG. 6 and treating the resultant powder in the same procedure as described above. The portion of columnar structure amounts to about 20–30 weight percent of the ingot obtained by conventional means and is between about 70 and 80 weight percent of the ingot in accordance with the invention. Thus, it is confirmed that the magnetic properties have been improved as the portion of the columnar structure increases in percentage in the macrostructure of the ingot in accordance with the invention.

EXAMPLE 2

Under the same conditions as those in Example 1 in accordance with the invention, 1 kg of raw material was melted and cast in the same mold shown in FIG. 3 at a molten metal temperature of 1590° C. The alloy composition may be represented by the formula as follows:

$$Sm(Co_{0.605}Cu_{0.08}Fe_{0.3}Ti_{0.015})_{8.2}$$

The magnet was prepared under the manufacturing conditions recited in Example 1. The properties of the magnet obtained were as follows:

| Magnetic Property | Measured Value |
|---|---|
| Br (KG) | 8.56 |
| bHc (KOe) | 6.75 |
| iHc (KOe) | 10.1 |
| $BH_{max.}$ | 15.9 MGOe |
| Density | 7.16 g/cm$^3$ |

In this alloy, the columnar zone accounts for about 75 percent by volume of the alloy.

EXAMPLE 3

Under the same conditions as those of Example 1 in accordance with the invention, 1 kg of raw material was melted and cast in the same mold shown in FIG. 3 at a molten metal temperature of 1590° C. The alloy composition may be represented by the formulas follows:

$$Sm(Co_{0.6}Cu_{0.08}Fe_{0.3}Hf_{0.02})_{8.26}$$

The magnet was prepared under the manufacturing conditions recited in Example 1. The properties of the magnet obtained were as follows:

| Magnetic Property | Measured Value |
|---|---|
| Br (KG) | 8.68 |
| bHc (KOe) | 7.00 |
| iHc (KOe) | 9.8 |
| $BH_{max.}$ | 16.15 MGOe |
| Density | 7.20 g/cm$^3$ |

In this alloy, the columnar zone accounts for about 80 percent by volume of the alloy.

EXAMPLE 4

Under the same conditions as those of Example 1 in accordance with the invention, 1 kg of raw material was melted and cast in the same mold shown in FIG. 3 at a molten metal temperature of 1590° C. The alloy composition may be represented by the formula as follows:

$$Sm(Co_{0.604}Cu_{0.08}Fe_{0.3}Ta_{0.016})_{8.3}$$

The magnet was prepared under the manufacturing conditions recited in Example 1. The properties of the magnet obtained were as follows:

| Magnetic Property | Measured Value |
|---|---|
| Br (KG) | 8.60 |
| bHc (KOe) | 6.95 |
| iHc (KOe) | 10.9 |

-continued

| Magnetic Property | Measured Value |
|---|---|
| $BH_{max.}$ | 16.0 MGOe |
| Density | 7.06 g/cm$^3$ |

In this alloy, the columnar zone accounts for about 70 percent by volume of the alloy.

EXAMPLE 5

Under the same conditions as those of Example 1 in accordance with the invention, 1 kg of raw material was melted and cast in the same mold shown in FIG. 3 at a molten metal temperature of 1590° C. The alloy composition may be represented by the formula as follows:

$$Sm(Co_{0.604}Cu_{0.08}Fe_{0.3}Zr_{0.01}Hf_{0.006})_{8.3}$$

The magnet was prepared under the manufacturing conditions recited in Example 1. The properties of the magnet obtained were as follows:

| Magnetic Property | Measured Value |
|---|---|
| Br (KG) | 8.68 |
| bHc (KOe) | 7.00 |
| iHc (KOe) | 11.0 |
| $BH_{max.}$ | 16.2 MGOe |
| Density | 7.10 g/cm$^3$ |

In this alloy, the columnar zone accounts for about 72 percent by volume of the alloy. In this example, Zr and Hf were used in combination as element M in the alloy composition. The magnetic properties obtained of the resultant magnet were as favorable as those for the magnet prepared in accordance with Example 1.

EXAMPLE 6

Under the same conditions as those of Example 1 in accordance with the invention, 1 kg of raw material was melted and cast in the same mold shown in FIG. 3 at a molten metal temperature of 1590° C. The alloy composition may be represented by the formula as follows:

$$Sm(Co_{0.602}Cu_{0.08}Fe_{0.3}V_{0.018})_{8.25}$$

The magnet was prepared under the manufacturing conditions recited in Example 1. The properties of the magnet obtained were as follows:

| Magnetic Property | Measured Value |
|---|---|
| Br (KG) | 8.50 |
| bHc (KOe) | 6.65 |
| iHc (KOe) | 10.1 |
| $BH_{max}$ | 15.6 MGOe |
| Density | 7.15 g/cc |

In this alloy, the columnar zone accounts for about 70 percent by volume of the alloy.

EXAMPLE 7

Figure 8:
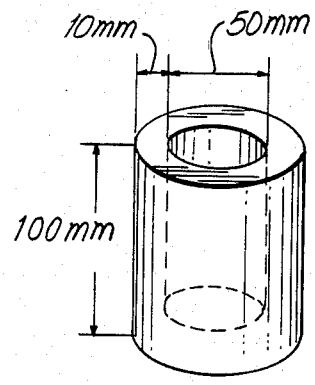
FIG. 8 is a perspective view showing a cylindrical casting mold of iron utilized in accordance with the invention.
Figure 9:
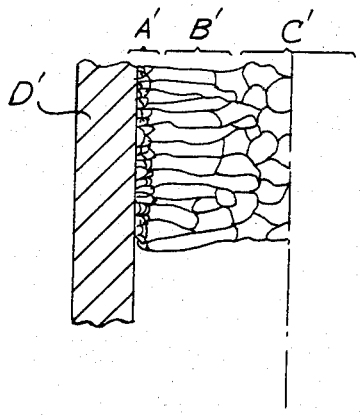
FIG. 9 is a cross-sectional view of an ingot formed in the mold of FIG. 8.

A 1 kg alloy having a composition as shown in the column enumerated "Alloy 1" in Table 1 was melted in an aluminum crucible in a high-frequnecy wave furnace. The molten alloy was cast at a temperature of 1600° C. in a metal iron mold having a construction as illustrated in FIG. 8. The mold has a wall thickness of 10 mm. FIG. 9 illustrates the macrostructure of the alloy ingot in crosssection. The various portions of the structure include a chilled layer indicated as A', a columnar zone indicated as B' and an equiaxed zone as C'.

Ingots were cut out of portions A', B' and C' in the cast mass of the alloy having the composition of Alloy 1. Each of the cut ingots is a solid solution which was treated at a temperature in the range of from about 1140° to 1180° C. and then subjected to an aging treatment at 800° C. The ingots were then magnetically hardened and pulverized into a powder. The powder was kneaded with 2.1 percent weight percent of epoxy-type organic binder added thereto. The resultant mixture was compressed in a magnetic field and heated at 150° C. for two hours to cure the resin in the compressed solid to form the permanent magnet.

The magnet had a cylindrical shape of a cylinder measuring 15 mm in diameter and 6 mm in length.

Figure 10:
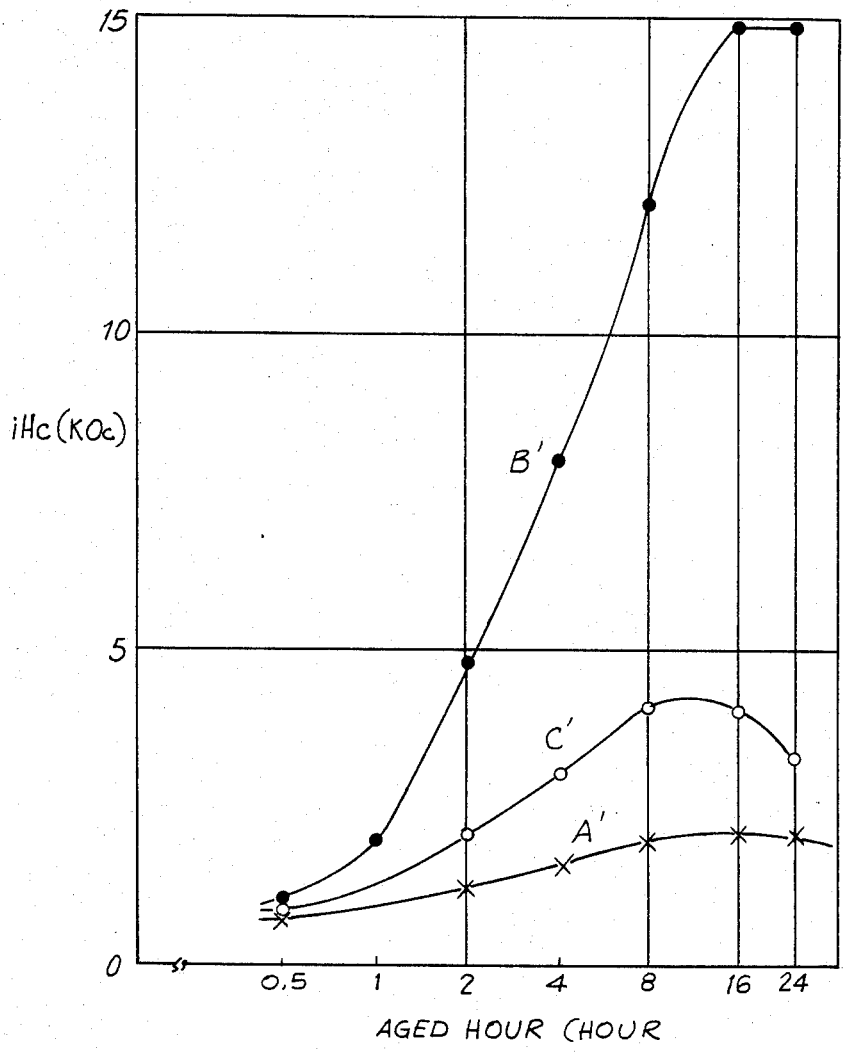
FIG. 10 is a graph illustrating the magnetic properties of permanent magnets produced from various zones of ingots prepared in accordance with the invention after aging.

The relationships between magnetic properties of the resultant magnets formed from the various macrostructure portions of Alloy 1 are shown in FIGS. 10 and 11. FIG. 10 shows the relationship between coercive force (iHc) and the aging time at 800° C. The symbols A', B' and C' denote the portions of the chilled layer, the columnar zone and the equi-axed crystals, respectively. FIG. 11 shows the relationship between saturated magnetization ($4\pi Is$) and the aging time for each portion. As noted from both FIGS. 10 and 11, the magnet formed from zone B' of columnar crystal exhibits higher magnetic properties than from the other portions.

TABLE 1

| | Alloy 1 | Alloy 2 | Alloy 3 |
|---|---|---|---|
| Sm | 23.12 | 26.59 | 21.54 |
| Co | 51.15 | 47.06 | 52.20 |
| Cu | 6.57 | 9.44 | 6.70 |
| Fe | 15.87 | 15.21 | 16.19 |
| Zr | 3.30 | 1.69 | 3.37 |

(In percent by weight (wt %))

EXAMPLE 8

Alloys having the compositions shown in the columns enumerated "Alloy 2" and "Alloy 3" in Table 1 were melted in accordance with the same procedure followed in Example 7. The molten alloys were cast at a temperature of 1600° C. in the iron mold having the dimensions illustrated in FIG. 12(*a*). The mold shown in FIG. 12(*a*) is an air cooled mold and the modified mold of FIG. 12(*b*) is a mold having a copper pipe wound thereabout so that it may be cooled with circulating water in a water cooling device 10.

The molds of FIGS. 12(*a*) and (*b*) are identical in size, shape and material except for water cooling device 10. Alloys having compositions indicated in columns Alloy 1 and Alloy 3 of Table 1 were melted in accordance with the method described in Example 7. Two ingots were prepared in the molds shown in FIGS. 12(*a*) and (*b*). Additionally, one additional ingot was produced by cooling the molten metal directly in the crucible of FIG. 8.

The structures of the three ingots each of Alloy 1 and Alloy 3 formed by different cooling speeds reveals different structures. The ingots of Alloy 1 and Alloy 3 which were prepared by water cooling in the mold of FIG. 12(*b*) were formed substantially wholly of chilled crystals. In contrast, the ingots of Alloy 1 and Alloy 3 obtained by air cooling contain more than 90 volume percent of columnar crystals than those cooled within the crucibles are formed of coarsened equi-axed crystals.

The three types of ingots of each of Alloy 1 and Alloy 3 are each a solid solution treated under optimum conditions between 1140° and 1180° C. and subsequently aged at 800° C. for two hours and then at 700° C. for four hours. The procedure of Example 7 was then followed and resin-bound magnets were prepared from the alloy ingots. Each alloy ingot was tested for magnetic properties with the results being set forth in Table 2 and Table 3.

Table 2 represents the results of Alloy 1 magnets and Table 3 sets forth the properties of Alloy 3 magnets. The chemical formulas of each of the alloy compositions of Table 1 are as follows:

Alloy 1—$Sm(Co_{0.67}Cu_{0.08}Fe_{0.22}Zr_{0.028})_{8.40}$

Alloy 2—$Sm(Co_{0.645}Cu_{0.12}Fe_{0.22}Zr_{0.015})_{7.0}$

Alloy 3—$Sm(Co_{0.0.67}Cu_{0.08}Fe_{0.22}Zr_{0.028})_{9.20}$

TABLE 2

| | (Alloy 1) | | |
|---|---|---|---|
| Method of Cooling | Br (G) | bHc ($O_e$) | (BH) max ($MGO_e$) |
| Water cooling | 6800 | 2100 | 6.5 |
| Air cooling | 7600 | 5500 | 13.7 |
| Cooling in crucible | 7500 | 1800 | 6.0 |

TABLE 3

| | (Alloy 3) | | |
|---|---|---|---|
| Method of Cooling | Br (G) | bHc ($O_e$) | (BH) max ($MGO_e$) |
| Water cooling | 7050 | 1050 | 4.2 |
| Air cooling | 8100 | 5400 | 14.5 |
| Cooling in crucible | 7800 | 950 | 3.8 |

It is noted from the results set forth in Tables 2 and 3 that ingots obtained from alloys having compositions of Alloy 1 and Alloy 3, which have been air-cooled and have a substantial percentage of columnar crystalline structure, exhibit the highest magnetic properties.

EXAMPLE 9

Seven 50 kilogram permanent magnet alloy ingots having an alloy composition of 23.3 weight percent Sm, 4.9 weight percent Cu, 15.0 weight percent Fe, 2.0 weight percent Zr+Cr (molar ratio of 1:1) and the remainder being Co were prepared. The composition of the alloy ingots corresponds to that of Example 1 of U.S. Pat. No. 4,289,549 to Kasai. Each ingot specimen was prepared by melting in an atmosphere of argon gas using a low frequency wave furnace and casting in a mold 100 of the type illustrated in FIG. 13. The casting conditions, including the temperature of the molten metal and the casting speed are set forth in Table 4.

Figure 13:
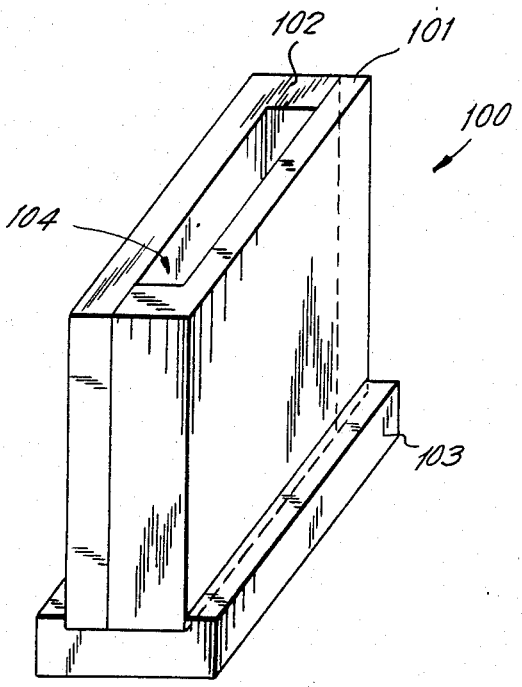
FIG. 13 is a perspective view illustrating a mold used for casting ingots in accordance with the invention.
Figure 14:
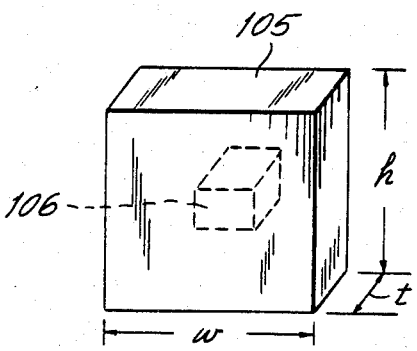
FIG. 14 is a perspective view of an ingot cast in accordance with the invention.

Referring to FIG. 13, mold 100 utilized for casting in this Example includes a pair of complementary carbon steel side plates 101 and 102 and a base plate 103 for forming a cavity 104. Molten metal is poured into cavity 104, cooled for yielding an alloy ingot 15 of dimension w, h and t as shown in FIG. 14. Alloy ingot 105 has the dimension width, w of about 35 cm, height h of about 35 cm and thickness t of about 4 cm.

An alloy ingot sample 106 of about 500 grams was removed from the center of alloy ingot 105. Alloy ingot 106 was pulverized into a fine powder of between 2–30 microns. After pulverization, the powder was compression-molded in a magnetic field and sintered to form a permanent magnet. The magnetic properties of the resulting magnet were evaluated and are set forth in Table 4 together with the casting conditions and percentage of columnar crystals formed during casting.

TABLE 4

| | casting condition | | magnetic properties | | | | ratio |
|---|---|---|---|---|---|---|---|
| sample-No. | temp. of molten metal (°C.) | casting speed (sec/kg) | Br (KG) | bHc ($KO_e$) | $(BH)_{max}$ ($MGO_e$) | ρ(g/cc) | of columnar crystal (%) |
| 1 | 1580 | 0.08 | 11.80 | 7.15 | 31.2 | 8.35 | 85 |
| 2 | 1580 | 0.15 | 11.75 | 7.14 | 31.0 | 8.34 | 80 |
| 3 | 1580 | 3.0 | 11.70 | 7.11 | 30.7 | 8.30 | 76 |
| 4 | 1580 | 5.0 | 11.67 | 7.08 | 30.5 | 8.30 | 72 |
| 5 | 1460 | 10.0 | 10.88 | 6.64 | 27.7 | 8.26 | 34 |
| 6 | 1460 | 0.15 | 11.20 | 6.72 | 28.1 | 8.27 | 41 |
| 7 | 1580 | 10.0 | 11.15 | 6.70 | 28.0 | 8.26 | 36 |

Sample No. 5 was formed under conventional casting conditions by melting to a temperature of about 1460° C., or about 200° C. over the melting point of the alloy composition and casting at about 10.0 sec.kg of alloy. As shown in the Table 4, the magnetic properties are improved substantially by altering the casting conditions to those in accordance with the invention, even when the alloy compositions are exactly the same. Additionally, it is evident from the magnetic properties of Sample Nos. 6 and 7 that the superior magnetic properties are attained only by satisfying both conditions in accordance with the invention; namely, a melting temperature of about 320° C. higher than the melting point of the alloy and a casting speed faster than about 5.0 sec/kg.

EXAMPLE 10

Seven samples of permanent magnet alloy ingots having an alloy composition of 23.0 weight percent Sm, 8.0 weight percent Cu, 21.0 weight percent Fe, 2.5 weight percent Ti and the remainder Co were prepared. Each specimen was melted, cast and pulverized into a fine powder in the same manner as Example 9. Following pulverization, the powders were mixed with 17% by volume epoxy resin and press-molded in a magnetic field to form a permanent magnet. Each permanent magnet sample corresponded to the composition set forth in Example 6 of the Kasai patent.

The casting conditions, magentic properties and percentage of columnar crystals in each magnet are shown in Table 5.

TABLE 5

| sample No. | casting condition: temp. of molten metal (°C.) | casting condition: casting speed (sec/kg) | magnetic properties: Br (KG) | magnetic properties: bHc ($KO_e$) | magnetic properties: $(BH)_{max}$ ($MGO_e$) | magnetic properties: ρ(g/cc) | ratio of columnar crystal (%) |
|---|---|---|---|---|---|---|---|
| 8 | 1580 | 0.08 | 8.85 | 6.92 | 16.6 | 7.18 | 83 |
| 9 | 1580 | 0.15 | 8.83 | 6.90 | 16.5 | 7.17 | 80 |
| 10 | 1580 | 3.0 | 8.77 | 6.85 | 16.3 | 7.15 | 75 |
| 11 | 1580 | 5.0 | 8.75 | 6.81 | 16.2 | 7.15 | 71 |
| 12 | 1460 | 10.0 | 8.21 | 5.58 | 15.3 | 7.12 | 32 |
| 13 | 1580 | 0.15 | 8.23 | 5.60 | 15.5 | 7.13 | 38 |
| 14 | 1460 | 10.0 | 8.25 | 5.59 | 15.5 | 7.13 | 35 |

As shown in Table 5, the magnetic properties of a resin-bonded permanent magnet formed by mixing the magnetic powder with a resin binder are improved by casting the alloy ingot under conditions in accordance with the invention. Thus, an increased volume of columnar crystals and corresponding improved magnetic properties are attained when the casting conditions include a molten temperature of about 320° C. above the melting point of the alloy composition and a casting speed of at least about 5.0 sec/kg.

EXAMPLE 11

Seven 50 kilogram samples of permanent magnet alloy ingots having an alloy composition of 24.6 weight percent Sm, 5.9 weight percent Cu, 20.6 weight percent Fe, 2.01 weight percent Cr and the remainder Co were prepared. Each specimen was melted and cast under the conditions set forth in the following Table 6.

The mold used to form the ingot was that used in Example 9 as illustrated in FIG. 13. The dimensions of each alloy ingot obtained were w=35.2 cm, h=44.5 cm and t=4 cm. The weight of each ingot was 50.5 Kg. The ingots were treated in the same manner as set forth in Example 9 and alloy ingot 106 of about 500 grams was removed from the center of each alloy ingot 105 and pulverized into the fine powder. After pulverization, the powder was mixed with an epoxy resin in about 2.0 volume percent, press-molded in a magnetic field to form the permanent magnet.

Each specimen 15–21 was melted to a temperature of 1580° C. and cast under various casting speeds as set forth in Table 6.

TABLE 6

| sample No. | casting condition: temp. of molten metal (°C.) | casting condition: casting speed (sec/kg) | magnetic properties: Br (KG) | magnetic properties: bHc ($KO_e$) | magnetic properties: $(BH)_{max}$ ($MGO_e$) | magnetic properties: ρ(g/cc) | ratio of columnar crystal (%) |
|---|---|---|---|---|---|---|---|
| 15 | 1580 | 0.05 | — | — | — | — | — |
| 16 | 1580 | 0.08 | 8.85 | 6.83 | 16.7 | 7.18 | 85 |
| 17 | 1580 | 0.15 | 8.83 | 6.80 | 16.6 | 7.17 | 83 |
| 18 | 1580 | 3.0 | 8.80 | 6.79 | 16.2 | 7.16 | 78 |
| 19 | 1580 | 5.0 | 8.73 | 6.77 | 15.9 | 7.15 | 75 |
| 20 | 1580 | 8.0 | 8.32 | 5.95 | 14.3 | 7.13 | 38 |
| 21 | 1580 | 10.0 | 8.30 | 5.92 | 14.2 | 7.12 | 32 |

As shown in Table 6, the casting speed of Sample No. 15 was so fast that the molten metal shattered. Thus, this sample could not be poured into mold 100 and an ingot was not obtained. In view of the substantial decrease in percent of columnar crystals obtained when the casting speed is slower than 5.0 sec/kg., the preferable range of casting speed is between about 0.08 through 5.0 sec/kg.

EXAMPLE 12

Six magnet specimens having alloy ingot compositions the same as Example 1 were melted and cast under the conditions set forth in the following Table 7. In the same manner as Example 9, alloy ingot 106 was removed from ingot 105 and pulverized into a fine powder. After pulverization, the powder was mixed with 2.0 volume percent epoxy resin and press-molded in a magnetic field in order to form the permanent magnet.

TABLE 7

| sample No. | casting condition: temp. of molten metal (°C.) | casting condition: casting speed (sec/kg) | magnetic properties: Br (KG) | magnetic properties: bHc ($KO_e$) | magnetic properties: $(BH)_{max}$ ($MGO_e$) | magnetic properties: ρ(g/cc) | ratio of columnar crystal (%) |
|---|---|---|---|---|---|---|---|
| 22 | 1500 | 0.15 | 8.35 | 5.98 | 14.5 | 7.13 | 46 |
| 23 | 1550 | 0.15 | 8.79 | 6.77 | 16.2 | 7.16 | 75 |
| 24 | 1580 | 0.15 | 8.83 | 6.81 | 16.6 | 7.17 | 83 |
| 25 | 1650 | 0.15 | 8.83 | 6.85 | 16.7 | 7.17 | 83 |
| 26 | 1680 | 0.15 | 8.85 | 6.90 | 16.8 | 7.18 | 85 |
| 27 | 1700 | 0.15 | 8.75 | 6.71 | 15.5 | 7.14 | 70 |

As shown in Table 7, even when the casting speed is faster than 5 sec/kg, the magnetic properties are poor when the temperature of the molten metal is less than 1550° C. In the composition of this Example 12 and Example 9, the melting point of the alloy is 1228° C.

Thus, the value 1550° C. of Sample No. 23 satisfies the condition that the temperature of the molten material must be at least 320° C. higher than the melting point of the alloy.

Sample No. 27 which was melted at a temperature of 1700° C. exhibited decreased magnetic properties because the temperature of molten metal was so high that the surface of the mold melted and undesirable impurities were mixed into the ingot. Therefore, it is preferable that the temperature range of the molten material in accordance with the invention should be less than that the critical temperature at which the surface of a metal mold will melt causing impurities to enter into the ingot. In the specific alloys utilized herein, preferably, the temperature range in accordance with the invention is between about 320° C. to 450° C. above the melting point of the alloy composition. In this Example, the preferred range of temperature is between about 1550° C. to 1680° C.

As shown from Examples 9–12, it is necessary that both the casting speed and temperature of the molten metal be within the preferred ranges in accordance with the invention in order to attain alloys of a predominately columnar structure and improved magnetic properties. Thus, the present invention resides in converting the cast structure of the alloy into that of a predominantly columnar structure wherein the columnar structure accounts for at least 50 volume percent of the structure. By providing this structure, the magnetic properties of the powder-bonded magnet obtained by use of the $SM_2Co_{17}$-type crystals can be enhanced to a remarkable extent. Additionally, at the same time, the invention permits the alloy itself to be mass produced in the form of large ingots weighing between 5 and 100 kg, for example and then forming permanent magnets of a desired size. Thus, the invention is indeed useful to the art.

It will thus be seen that the objects set forth above, among those made apparent from the preceding description, are efficiently attained and, since certain changes may be made in carrying out the above processes, in the described products, and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A permanent magnet alloy ingot comprising an alloy of samarium (Sm) and cobalt (Co), copper (Cu), iron (Fe) and at least one element (M) selected from the group of elements consisting of zirconium (Zr), titanium (Ti), hafnium (Ha), tantalum (Ta), niobium (Nb) and vanadium (V), formed predominately of $Sm_2Co_{17}$ crystals and having at least about 50 volume percent columnar crystals in the macrostructure of the alloy.

2. The alloy ingot of claim 1, wherein the component elements are present within the following ranges:

| Element | Percent Weight |
|---|---|
| Sm | 21.0–28.0 |
| Cu | 3.0–10.0 |
| Fe | 14.0–35.0 |
| M | 0.5–5.0 |
| Co | Balance to 100. |

3. The alloy ingot of claim 1, wherein the columnar crystals represent at least about 70 volume percent of the crystals.

4. A process of preparing a permanent magnet alloy ingot formed from an alloy composition of samarium (Sm) and cobalt (Co), copper (Cu), iron (Fe) and at least one element (M) selected from the group consisting of zirconium (Zr), titanium (Ti), hafnium (Hf), tantalum (Ta), niobium (Nb) and vanadium (V), including predominately $Sm_2Co_{17}$ crystals and having at least 50 volume percent columnar crystals in macrostructure of the ingot comprising:

melting the alloy composition at a temperature of at least about 320° C. higher than the melting point of the alloy composition; and casting the ingot in a mold at a casting speed of at least about 5.0 sec/kg of alloy to obtain an alloy ingot.

5. The process of claim 4, wherein the melting of the alloy composition is carried out at a temperature between about 320° C. higher than the melting point of the alloy composition to the critical temperature of the surface of the mold.

6. The process of claim 4, comprising casting at a casting speed between about 0.18 to 5.0 sec/kg of the alloy.

7. The process of claim 4, comprising melting the alloy composition at a temperature between about 320° C. above the melting point of the alloy composition to the critical temperature of the surface of the mold and casting at a speed between about 0.18 and 5.0 sec/kg.

8. A powder-bonded permanent magnet comprising a compressed magnetic powder of an alloy of samarium (Sm) and cobalt (Co), copper (Cu), iron (Fe) and at least one element (M) selected from the group of elements consisting of zirconium (Zr), titanium (Ti), hafnium (Hf), tantalum (Ta), niobium (Nb) and vanadium (V), formed predominately of $Sm_2Co_{17}$ crystals formed from an alloy ingot having at least about 50 volume percent columnar crystals in the macrostructure, said ingot prepared by mixing the components to form an alloy composition, melting the composition at a temperature at least about 320° C. higher than the melting point of the composition and casting to form an alloy ingot at a casting speed of at least about 5.0 sec/kg of alloy.

9. The powder-bonded permanent magnet composition of claim 8, further comprising a resin binder admixed with said magnetic powder.

10. The powder-bonded permanent magnet composition of claim 9, wherein the resin binder is selected from the group consisting of epoxy resins, EVA, rubber, polyester and nylon.

11. The powder-bonded permanent magnet composition of claim 9, wherein the resin binder is present between about 1.0 to 15.0 weight percent, based on the total weight.

12. A process of preparing a powder-bonded permanent magnet from an alloy ingot of samarium (Sm) and cobalt (Co), copper (Cu), iron (Fe) and at least one element (M) selected from the group consisting of zirconium (Zr), titanium (Ti), hafnium (Hf), tantalum (Ta), niobium (Nb) and vanadium (V), including predominately $Sm_2Co_{17}$ crystals having a substantially columnar macrostructure when cast, comprising:

mixing in an inert atmosphere an alloy composition including Sm between about 21 and 28 weight percent, Cu between about 3 and 10 weight percent, Fe between about 14 and 35 weight percent, M between about 0.5 and 5.0 weight percent with the balance cobalt to make up 100 weight percent;

melting the alloy composition at a temperature of at least about 320° C. above the melting point of the composition;

casting the composition at a casting speed of at least about 5.0 sec/kg to obtain an alloy ingot;

subjecting the alloy ingot to a thermal treatment step;

pulverizing the ingot to a powder; and compressing the magnetic powder in a magnetic field to form the permanent magnet.

13. The process of claim 12, further including the steps of incorporating a binder into the magnetic powder and compressing the powder and binder in a magnetic field to form the permanent magnet.

14. The process of claim 12, wherein the melting is carried out at temperatures from about 320° C. above the melting point of the alloy composition to the critical temperature of the surface of the mold.

15. The process of claim 12, wherein the casting speed is between about 0.18 and 5.0 sec/kg.

16. The process of claim 12, wherein the melting is carried out at a temperature between about 320° C. above the melting point of the composition to the critical temperature of the surface of the mold and the casting speed is between about 0.18 and 5.0 sec/kg.

17. A permanent magnet alloy ingot comprising an alloy of samarium (Sm) and cobalt (Co), copper (Cu), iron (Fe) and at least one element (M) selected from the group of elements consisting of zirconium (Zr), titanium (Ti), hafnium (Hf), tantalum (Ta), niobium (Nb) and vanadium (V) formed predominately of $Sm_2Co_{17}$ crystals and having at least about 50 volume percent columnar crystals in the macro-structure of the alloy, formed by:

melting the alloy composition at a temperature of at least about 320° C. higher than the melting point of the alloy composition; and casting the alloy into an ingot in a mold at a casting speed of at least about 5.0 sec/kg of alloy to obtain the alloy ingot.

18. The permanent magnet alloy ingot of claim 17, wherein the melting of the alloy composition was carried out at a temperature between about 320° C. higher than the melting point of the alloy composition and the critical temperature of the surface of the mold.

19. The permanent magnet alloy ingot of claim 17, wherein the ingot was cast at a casting speed between about 0.18 to 5.0 sec/kg of the alloy.

20. The permanent magnet alloy ingot of claim 17, wherein the alloy composition was melted at a temperature between about 320° C. above the melting point of the alloy composition and the critical temperature of the surface of the mold and was cast at a speed between about 0.18 and 5.0 sec/kg.

21. A powder-bonded permanent magnet formed from an alloy ingot of samarium (Sm) and cobalt (Co), copper (Cu), iron (Fe) and at least one element (M) selected from the group consisting of zirconium (Zr), titanium (Ti), hafnium (Hf), tantalum (Ta), niobium (Nb) and vanadium (V) including predominantly $Sm_2Co_{17}$ crystals having a substantially columnar microstructure when cast, obtained by:

mixing in an inert atmosphere an alloy composition including Sm between about 21 and 28 weight percent, Cu between about 3 and 10 weight percent, Fe between about 14 and 35 weight percent, M between about 0.5 and 5.0 weight percent with the balance cobalt to make up 100 weight percent;

melting the alloy composition at a temperature of at least about 320° C. above the melting point of the composition;

casting the composition at a casting speed of at least about 5.0 sec/kg to obtain an alloy ingot;

subjecting the alloy ingot to a thermal treatment step;

pulverizing the ingot to a powder; and compressing the magnetic powder in a magnetic field to form the permanent magnet.

22. The powder-bonded permanent magnet of claim 21, wherein the binder was incorporated into the magnetic powder and compressed in a magnetic field to form the permanent magnet.

23. The powder-bonded permanent magnet of claim 21, wherein the alloy was melted at a temperature from about 320° C. above the melting point of the alloy composition and the critical temperature of the surface of the mold.

24. The powder-bonded permanent magnet of claim 21, wherein the ingot was cast at a speed between about 0.18 and 5.0 sec/kg.

25. The powder-bonded permanent magnet of claim 21, wherein the alloy was melted at a temperature between about 320° C. above the melting point of the composition and the critical temperature of the surface of the mold and the casting speed was maintained between about 0.18 and 5.0 sec/kg.

* * * * *